US007543908B2

(12) United States Patent
Jones et al.

(10) Patent No.: US 7,543,908 B2
(45) Date of Patent: Jun. 9, 2009

(54) CLEARING SILICATE KOGATION

(75) Inventors: Morgan G. Jones, San Diego, CA (US); Satya Prakash, Poway, CA (US); Jeffrey D. Langford, Lebanon, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 486 days.

(21) Appl. No.: 11/209,574

(22) Filed: Aug. 23, 2005

(65) Prior Publication Data

US 2007/0052761 A1 Mar. 8, 2007

(51) Int. Cl.
*B41J 2/165* (2006.01)
*B41J 2/05* (2006.01)

(52) U.S. Cl. ..... 347/26; 347/62

(58) Field of Classification Search ..... 347/5–6, 347/10–11, 14, 22–23, 26, 17, 1, 19, 62; 358/1.8

See application file for complete search history.

(56) References Cited

U.S. PATENT DOCUMENTS 5,440,330 A * 8/1995 Anderson et al. ..... 347/26
6,128,098 A * 10/2000 Kamada et al. ..... 358/1.8
6,425,659 B1 7/2002 Katsuragi et al.
6,533,398 B2 3/2003 Katsuragi et al.
6,902,264 B2 6/2005 Katsuragi et al.
2002/0113831 A1 8/2002 Su et al.
2002/0113842 A1 8/2002 Katsuragi et al.
2003/0015119 A1 1/2003 Lee et al.

FOREIGN PATENT DOCUMENTS

JP 10315502 A * 12/1998

OTHER PUBLICATIONS

Morita, et al., NMD/PDS/Fuji Xerox Co., Long-Stable Jetting on Thermal Ink Jet Printers, Recent Progress in Ink Jet Tech. II, 1999, IS&T, Chapter 2, Thermal Ink Jet, pp. 39-42.

* cited by examiner

*Primary Examiner*—Hai C Pham

(57) ABSTRACT

Systems, methodologies, media, and other embodiments associated with clearing silicate based kogation from heating resistors employed in ink jet printing are described. One exemplary system embodiment includes a silicate kogation clearing logic configured to pulse the heating resistor at a high frequency and low pulse width to heat the resistor surface to a temperature below that required to form an ink bubble and thus below that required to eject a drop of ink. Heating the resistor facilitates breaking bonds between the silicate based kogation and the heating resistor.

26 Claims, 4 Drawing Sheets

CLEARING SILICATE KOGATION

BACKGROUND

In a thermal ink jet printing system, ink is ejected as ink droplets from a print head as a result of rapid volumetric expansion of the ink after the application of thermal energy to the ink. A heater (e.g., resistor) in the print head can be rapidly heated to supply the thermal energy to ink that is in contact with the resistor. Heating the ink to at least its boiling point will create bubbles in the ink. The bubbles experience a rapid volumetric increase forcing a droplet to be ejected from a print head nozzle. The ink may include materials that over time may bond to and build up on the heater surface. This build up may be referred to as kogation. Kogation can reduce the efficiency and useful life of a print head by affecting the thermal transfer properties of the heater surface. Thus, various approaches have been taken to mitigate the effects of kogation.

One approach has been to craft designer inks that contain various materials designed to limit kogation. Some designer inks may be crafted to be so pure that they do not provide residual materials from which kogation may form. However, some inks (e.g., high pH inks) may react with other materials (e.g., silicates) in a print head and cause materials (e.g., silicates) to enter the ink. These silicates may be available for kogation formation on a heater like a resistor. The silicates may be produced when the high pH ink reacts with materials including, for example, a silicon die, a glass-reinforced print head body, and so on.

BRIEF DESCRIPTION OF THE DRAWINGS

The accompanying drawings, which are incorporated in and constitute a part of the specification, illustrate various example systems, methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

Figure 1:
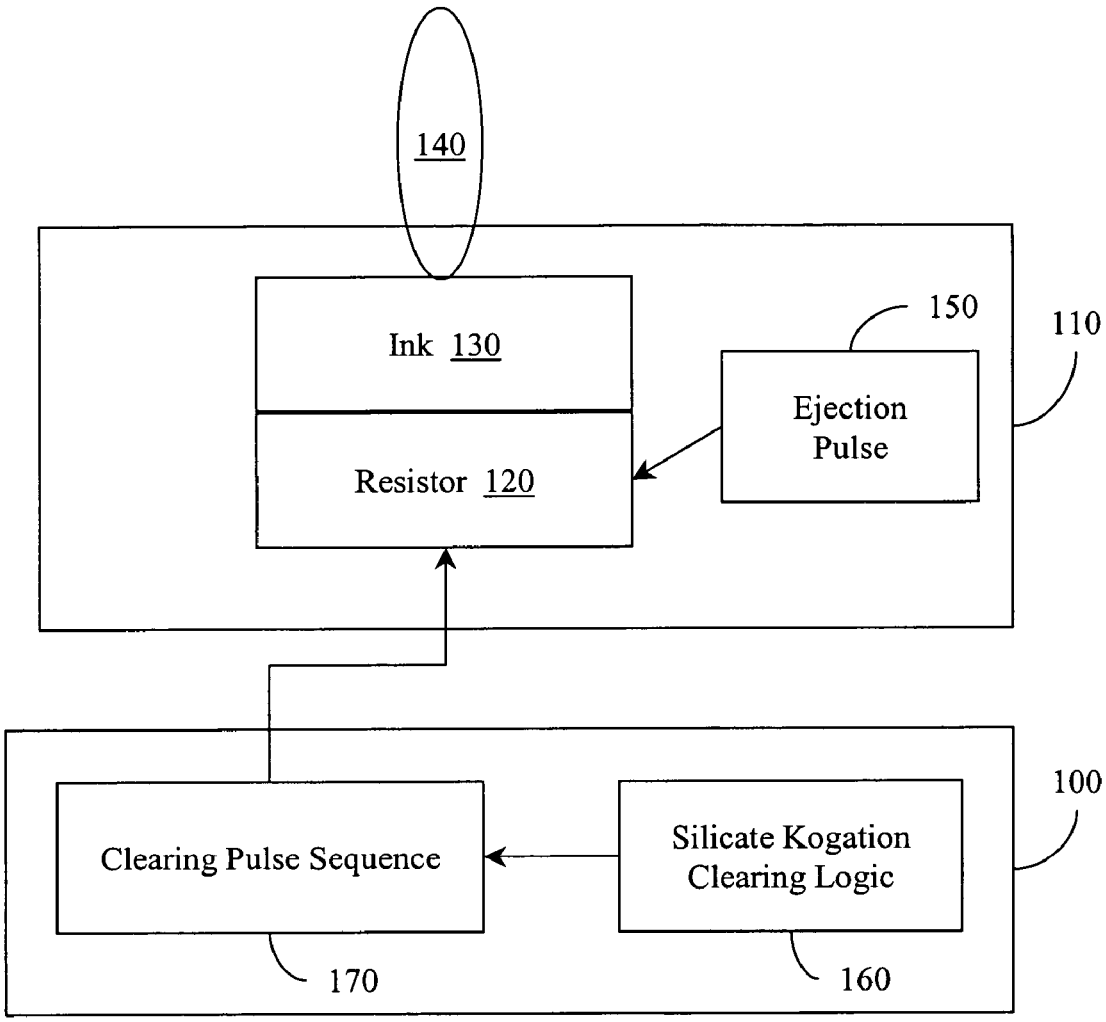
FIG. 1 illustrates an example system for clearing silicate kogation from a thermal ink jet print head resistor.

Example systems, methods, media, and other embodiments described herein relate to clearing silicate kogation from a resistor in a thermal ink jet printing apparatus. Thermal print heads employed in ink jet printing include a heater (e.g., resistor) that may be located, for example, on the floor of an ink channel near a print head nozzle. To print, an electrical signal is applied to the resistor causing the temperature of the resistor to rise which in turn causes the temperature of the ink to rapidly rise beyond its boiling point. The transition from liquid to vapor creates a bubble whose volume rapidly expands causing a drop to be ejected out the nozzle. When the drop is ejected, the bubble collapses back onto the heater and is ready to be reheated for the next cycle. This process is repeatable many (e.g., thousands) times per second. Thus, the electrical signal may be provided in an ejection pulse that is very short (e.g., <0.001 seconds).

Thermal print head resistors may be susceptible to kogation. An element, additive, or other material in the ink may adhere to the resistor. In one example, inks having a high pH (e.g., pH>9) may chemically attack silicates in print head materials. The chemical reaction of the high pH ink with the print head materials may lead to the ink becoming silicon rich over time. Thus, silicate based kogation may form on resistor surfaces that come in contact with the silicon rich ink. The kogation may impact heat transfer properties of the resistor which may in turn impact drop ejection, print head life span, and so on.

Example systems and methods facilitate removing the silicate based kogation from the resistor(s) in an ink jet print head. One example system includes a silicate clearing logic configured to heat a resistor at a temperature below that required to eject an ink drop from a print head but at a temperature above that required to remove the silicate based kogation. In one example, the heating may break bonds between the silicate based kogation and the resistor.

In one example, the silicate clearing logic may be a reactive component that is configured to react to detected kogation and/or performance degradation. By way of illustration, clearing may be triggered when drop velocity and/or drop weight fall outside writing system specifications. The drop size and/or drop velocity may be monitored, for example, by a drop detect sensor. In another example, the silicate clearing logic may be a proactive component that is configured to periodically initiate clearing and/or to predict when silicate based kogation clearing may be required and to automatically schedule and/or initiate the clearing. By way of illustration, clearing may be triggered after each N (e.g., 100,000) drops are ejected from a nozzle. This may occur regardless of whether kogation is present.

Heating the resistor for purposes other than ejecting ink drops is not without peril. For example, overheating the resistor or heating it in the absence of a liquid may be detrimental to the resistor life span. Thus, example systems and methods may use a more narrow pulse width than is used for ejecting a drop and may maintain the presence of ink during clearing. By way of illustration, a clearing pulse width may be about 30% to 70% of the width of an ejection pulse used in ejecting a drop of ink. The clearing pulse may employ the same voltage as the ejection pulse. Maintaining the presence of the ink during clearing may facilitate breaking a chemical bond between the resistor and the kogation, which may in turn facilitate having the silicate based kogation enter solution in the ink. Kogation that breaks free from the resistor surface and that does not go into solution in the ink may be expelled from the print head during a clearing drop(s) ejection sequence performed after the clearing pulsing.

The following includes definitions of selected terms employed herein. The definitions include various examples and/or forms of components that fall within the scope of a term and that may be used for implementation. The examples are not intended to be limiting. Both singular and plural forms of terms may be within the definitions.

"Computer-readable medium", as used herein, refers to a medium that participates in directly or indirectly providing signals, instructions and/or data. A computer-readable medium may take forms, including, but not limited to, non-volatile media, volatile media, and transmission media. Non-volatile media may include, for example, optical or magnetic disks and so on. Volatile media may include, for example, semiconductor memories, dynamic memory and the like. Transmission media may include coaxial cables, copper wire, fiber optic cables, and the like. Transmission media can also take the form of electromagnetic radiation, like that generated during radio-wave and infra-red data communications, or take the form of one or more groups of signals. Common forms of a computer-readable medium include, but are not limited to, a floppy disk, a hard disk, a magnetic tape, other magnetic medium, a CD-ROM, other optical medium, a RAM (random access memory), a ROM (read only memory), an EPROM, a FLASH-EPROM, or other memory chip or card, a memory stick, a carrier wave/pulse, and other media from which a computer, a processor or other electronic device can read. Signals used to propagate instructions or other software over a network, like the Internet, can be considered a "computer-readable medium."

"Logic", as used herein, includes but is not limited to hardware, firmware, software and/or combinations of each to perform a function(s) or an action(s), and/or to cause a function or action from another logic, method, and/or system. For example, based on a desired application or needs, logic may include a software controlled microprocessor, discrete logic like an application specific integrated circuit (ASIC), an analog circuit, a digital circuit, a programmed logic device, a memory device containing instructions, or the like. Logic may include one or more gates, combinations of gates, or other circuit components. Logic may also be fully embodied as software. Where multiple logical logics are described, it may be possible to incorporate the multiple logical logics into one physical logic. Similarly, where a single logical logic is described, it may be possible to distribute that single logical logic between multiple physical logics.

An "operable connection", or a connection by which entities are "operably connected", is one in which signals, physical communications, and/or logical communications may be sent and/or received. Typically, an operable connection includes a physical interface, an electrical interface, and/or a data interface, but it is to be noted that an operable connection may include differing combinations of these or other types of connections sufficient to allow operable control. For example, two entities can be considered to be operably connected if they are able to communicate signals to each other directly or through one or more intermediate entities like a processor, an operating system, a logic, software, or other entity. Logical and/or physical communication channels can be used to create an operable connection.

Some portions of the detailed descriptions that follow are presented in terms of algorithms and symbolic representations of operations on data bits within a memory. These algorithmic descriptions and representations are the means used by those skilled in the art to convey the substance of their work to others. An algorithm is here, and generally, conceived to be a sequence of operations that produce a result. The operations may include physical manipulations of physical quantities. Usually, though not necessarily, the physical quantities take the form of electrical or magnetic signals capable of being stored, transferred, combined, compared, and otherwise manipulated in a logic and the like.

It has proven convenient at times, principally for reasons of common usage, to refer to these signals as bits, values, elements, symbols, characters, terms, numbers, or the like. It should be borne in mind, however, that these and similar terms are to be associated with the appropriate physical quantities and are merely convenient labels applied to these quantities. Unless specifically stated otherwise, it is appreciated that throughout the description, terms like processing, establishing, computing, calculating, determining, displaying, or the like, refer to actions and processes of a computer system, logic, processor, or similar electronic device that manipulates and transforms data represented as physical (electronic) quantities.

Example methods may be better appreciated with reference to flow diagrams. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks. While the figures illustrate various actions occurring in serial, it is to be appreciated that in different examples, various actions could occur concurrently, substantially in parallel, and/or at substantially different points in time.

FIG. 1 illustrates an apparatus 100 that includes a silicate kogation clearing logic 160 that is configured to facilitate clearing silicate based kogation from a thermal ink jet print head 110. The ink jet print head 110 may include a resistor 120 for heating ink 130. The ink 130 will be in contact with at least one surface of resistor 120. It is this surface that may be susceptible to kogation formation. As described above, heating the ink 130 can cause it to boil and to produce a bubble that may facilitate producing a drop 140 of ink. The ink jet print head 110 may therefore be configured to expel the drop 140 of ink in response to the resistor 120 heating the ink 130 to at least an ejection temperature.

As used herein, the phrases "heating the ink to" or "heating the ink to at least" refer to raising the temperature of the ink to and/or beyond a temperature. For example, "heating the ink to 212° F." would include heating the ink to 212° F., 212.1° F., 213° F., 220° F., and so on. The phrase "heating the ink to X but less than Y" refers to raising the temperature of the ink to at least X but not as high as Y. For example, "heating the ink to 212° F. but less than 230° F." refers to raising the temperature of the ink to at least 212° F. but not raising it as high as 230° F. This terminology applies whether the temperature is expressed as a discrete value (e.g., 212° F.), a conceptual value (e.g., boiling point), or as a percentage of a temperature (e.g., 50% of boiling point).

In one example, how resistor 120 is heated may be controlled by an ejection pulse 150 applied to the resistor 120. It will be appreciated that the ejection pulse is an electric signal having a voltage and duration (e.g., pulse width).

Apparatus 100 may include a silicate kogation clearing logic 160 that is operably connected to the resistor 120. The silicate kogation clearing logic 160 may be configured to provide a clearing pulse sequence 170 to control the resistor 120 to heat the ink 130 to a desired temperature for a desired period of time. The desired temperature may be, for example, in a clearing temperature range that is lower than the ejection temperature yet sufficient to facilitate breaking a bond between silicate based kogation on the resistor 120 and the resistor 120. The clearing pulse sequence 170 may include a set of pulses, each pulse having a voltage and duration (e.g., width). To facilitate clearing silicate based kogation, in one example, the width of a clearing pulse may be less than the width of an ejection pulse while the voltage of the clearing pulse may be the same as the voltage of the ejection pulse. In the example, voltage switching in apparatus 100 is not required and resistor 120 can be selectively heated to a temperature lower than that employed in printing yet sufficient to remove kogation from resistor 120.

In another example, clearing pulse sequence 170 may include a set of pulses whose width is less than the width of an ejection pulse and whose voltage is in a range from about 99% of the first voltage to about 101% of the first voltage. In this example, the set of pulses may be provided at a frequency of from about 36 KHz to about 48 KHz over a period of time of from about 5 seconds to about 60 seconds. In this example, the pulse width may be in the range of from about 30% of an ejection pulse width to about 70% of an ejection pulse width. While 99% to 101% of voltage, 36 KHz to 48 KHz, 5 to 60 seconds, and 30% to 70% of pulse width are described in the example, it is to be appreciated that other combinations of voltage, frequency, duration, and pulse width may be employed to heat resistor 120 to a temperature where ink 130 will not boil yet at which bonds between kogation on resistor 120 and resistor 120 will break down.

By way of illustration, in another case, the clearing pulse sequence 170 may include a set of pulses whose width is less than the width of an ejection pulse and whose voltage is in a range from about 90% of the first voltage to about 110% of the first voltage. In this example, the set of pulses may be provided at a frequency of from about 30 KHz to about 50 KHz over a period of time of from about 3 seconds to about 90 seconds. In this example, the pulse width may be in the range of from about 25% of an ejection pulse width to about 75% of an ejection pulse width.

To facilitate removing kogation, a relationship between the ejection temperature used to eject ink drops and a clearing temperature that will not eject ink drops is established. In one example, the ejection temperature will be at least the boiling temperature of the ink and the clearing temperature range will be less than the boiling temperature of the ink. In another example, the clearing temperature range will be from about 90% of the boiling temperature of the ink to about 99% of the boiling temperature of the ink.

While silicate kogation clearing logic 160 is illustrated attached to print head 110, it is to be appreciated that logic 160 may be located internal to and/or external to print head 110. Additionally, it is to be appreciated that in different examples silicate kogation clearing logic 160 may be detachably connectable to the ink jet print head 110. Similarly, while a single resistor 120 is illustrated, it is to be appreciated that ink jet print head 110 may include a plurality of resistors. In one example, after heating the resistor 120, the silicate kogation clearing logic 160 may be configured to control the print head 110 to expel a set of ink drops. This may facilitate ejecting pieces of kogation that break off from resistor 120.

The silicate kogation clearing logic 160 may be, for example, a reactive component and/or a proactive component. Thus, in one example, the silicate kogation clearing logic 160 may be configured to initiate a kogation clearing cycle in response to events including, detecting that drop weight has fallen below a desired drop weight, detecting that drop velocity has fallen below a desired drop velocity, and so on. In another example, the silicate kogation clearing logic 160 may be configured to initiate a kogation clearing cycle periodically (e.g., every N drops). In yet another example, silicate kogation clearing logic 160 may selectively initiate a clearing action based, at least in part, on predicting when a printing parameter (e.g., drop size, drop velocity) is likely to fall below a desired threshold.

Figure 2:
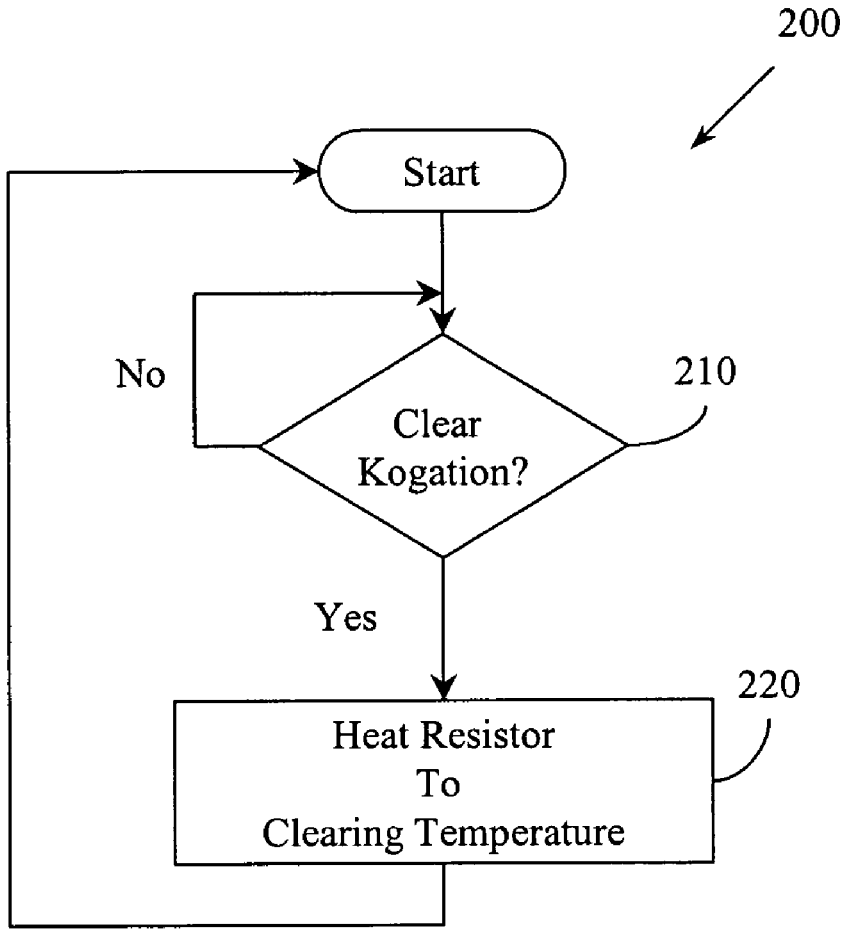
FIG. 2 illustrates an example methodology for clearing silicate kogation from a thermal ink jet print head resistor.

FIG. 2 illustrates an example method 200 associated with clearing silicate based kogation from an ink jet print head resistor. The elements illustrated in FIG. 2 denote "processing blocks" that may be implemented in logic. In one example, the processing blocks may represent executable instructions that cause a computer, processor, and/or logic device to respond, to perform an action(s), to change states, and/or to make decisions. Thus, described methodologies may be implemented as processor executable instructions and/or operations provided by a computer-readable medium. In another example, processing blocks may represent functions and/or actions performed by functionally equivalent circuits like an analog circuit, a digital signal processor circuit, an application specific integrated circuit (ASIC), or other logic device.

Method 200 may be performed in an ink jet printer that is configured with a resistor for heating an ink to an ejection temperature. The resistor may be susceptible to kogation formation. For example, an ink with a pH over 8.7 may attack silicates in print head materials causing the ink to become silicon rich. The resistor may heat up in response to being subjected to an electrical signal pulse. For example, the resistor heating may be controlled by an ejection pulse having an ejection pulse width and an ejection pulse voltage.

Method 200 may include, at 210, determining whether to clear silicate based kogation from the resistor. The determination at 210 may include, for example, determining whether a pre-defined number of drops of ink have been expelled by the ink jet printer, determining whether a print quality parameter has fallen below a pre-determined threshold, determining that a print quality parameter is approaching a pre-determined threshold, and so on. When the determination at 210 is Yes, processing may proceed to 220.

Processing at 220 may include heating at least a portion of the resistor to a clearing temperature. The clearing temperature is lower than the ejection temperature. How the resistor is heated may be controlled by providing a clearing pulse sequence to the resistor for a desired period of time. The clearing pulse sequence may include clearing pulses that will be provided to the resistor at a clearing pulse frequency. Each clearing pulse will have a clearing pulse width and a clearing pulse voltage that determine, at least in part, how hot the resistor will get. This control facilitates heating at least a portion of the resistor to the clearing temperature which in turn facilitates heating the ink to a temperature below the ejection temperature yet above a temperature that will remove silicate based kogation from the resistor.

Crafting the clearing pulse sequence facilitates establishing a relationship between the ejection temperature and the clearing temperature. In one example, the ejection temperature will be at least the boiling point of the ink and the clearing temperature will be less than the boiling point of the ink. To keep the clearing temperature below the boiling point of the ink, the clearing pulse sequence may be crafted with pulses having reduced properties when compared to an ejection pulse. For example, the clearing pulse width may be in the range of from about 30% of the ejection pulse width to about 70% of the ejection pulse width. While the clearing pulse voltage may be the same as the ejection pulse voltage, using the same voltage but for a shorter period of time will cause less heating.

With these types of pulses available, a sequence can be provided to the resistor for a desired period of time. For example, the clearing pulse sequence may include sending clearing pulses at a frequency in the range of about 36 KHz to about 48 KHz for a period of time in the range of from about 5 seconds to about 60 seconds. Thus, by heating the resistor on which the kogation has formed to a temperature below the temperature used for printing but for a time much longer than the time used for printing, bonds between kogation on the resistor and the resistor may be broken, which facilitates removing the kogation from the resistor. Keeping the ink temperature below its boiling point facilitates removing silicate based kogation from the resistor without inducing nucleation.

In one example, kogation removed from the resistor may go into solution in the ink. In another example, pieces (e.g., flakes, chips) of kogation may break off the resistor. Thus, method 200 may also include, (not illustrated), controlling the ink jet printer to expel a drop of ink by heating the ink. Expelling this drop(s) of ink may facilitate ejecting the broken off pieces of kogation from the print head.

In one example, methodologies are implemented as processor executable instructions and/or operations stored on a computer-readable medium. Thus, in one example, a computer-readable medium may store processor executable instructions operable to perform a method in an ink jet printer configured with a resistor for heating an ink to above an ejection temperature. In the printer, resistor heating may controlled by an ejection pulse. The method may include heating at least a portion of the resistor to a clearing temperature that is insufficient to heat the ink to above the ejection temperature. Heating the resistor may be controlled by providing a clearing pulse sequence to the resistor for a desired period of time. Heating at least the portion of the resistor to the clearing temperature will heat the ink to a temperature below the ejection temperature and above a temperature that will remove silicate-based kogation from the resistor. While the above method is described being stored on a computer-readable medium, it is to be appreciated that other example methods described herein can also be stored on a computer-readable medium.

Figure 3:
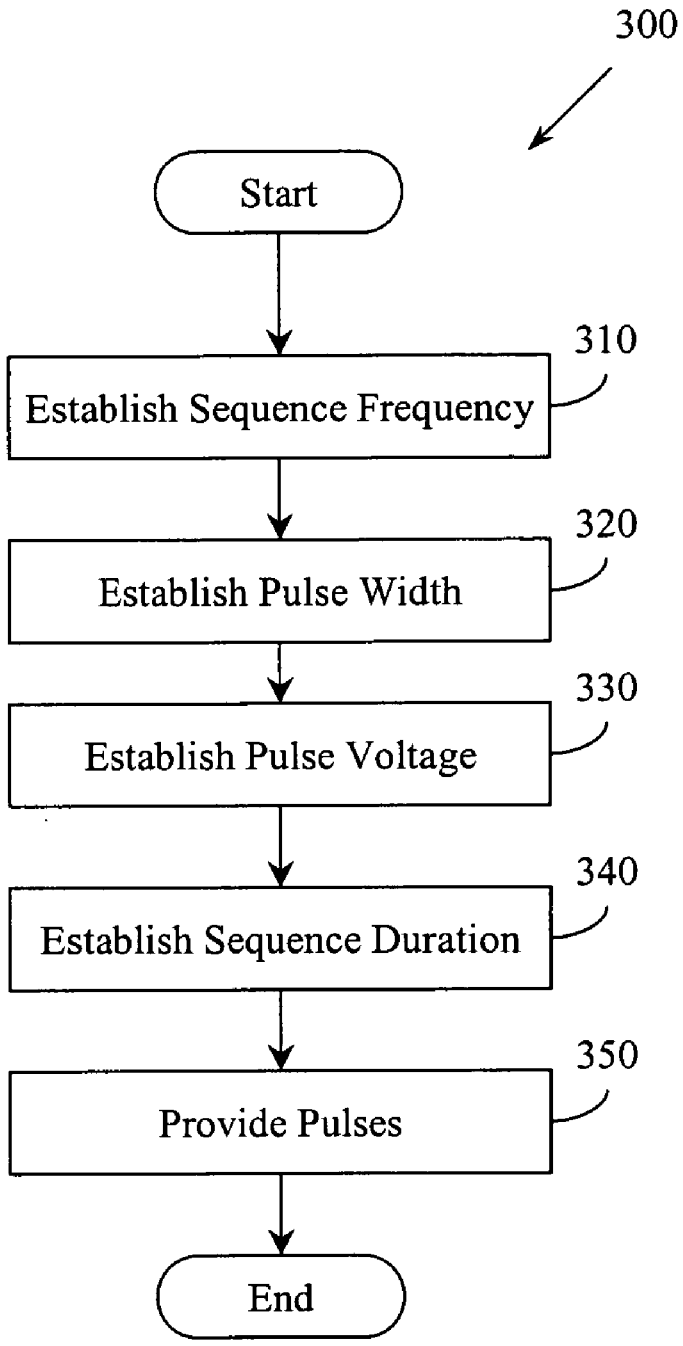
FIG. 3 illustrates another example methodology for clearing silicate kogation from a thermal ink jet print head resistor.

FIG. 3 illustrates an example method 300 associated with clearing silicate based kogation from a thermal ink jet print head resistor. Method 300 may include, at 310, establishing a frequency at which a pulse sequence will be provided to the resistor. Frequencies like those described in connection with apparatus 100 (FIG. 1) and method 200 (FIG. 2) may be examples of frequencies that are established.

Method 300 may also include, at 320, establishing a pulse width for pulses to be supplied to the resistor as part of the pulse sequence. Pulse widths like those described in connection with apparatus 100 (FIG. 1) and method 200 (FIG. 2) may be examples of pulse widths that are established.

Method 300 may also include, at 330, establishing a pulse voltage for pulses to be supplied to the resistor as part of the pulse sequence. Voltages like those described in connection with apparatus 100 (FIG. 1) and method 200 (FIG. 2) may be examples of durations that are established.

Method 300 may also include, at 340, establishing a period of time over which the pulse sequence will be supplied to the resistor. Durations like those described in connection with apparatus 100 (FIG. 1) and method 200 (FIG. 2) may be examples of durations that are established.

Having crafted the pulse sequence and the individual pulses that form the sequence, method 300 may also include, at 350, providing the pulses as the pulse sequence to the resistor. In one example the pulse sequence may be configured to heat the resistor to a temperature that will heat ink that is in contact with the resistor to a temperature between 75% of the boiling temperature of the ink and 99% of the boiling temperature of the ink. While 75% and 99% are described, it is to be appreciated that other upper and lower limits may apply.

While FIG. 3 illustrates various actions occurring in serial, it is to be appreciated that various actions illustrated in FIG. 3 could occur substantially in parallel. By way of illustration, a first process could establish the pulse sequence frequency, a second process could establish pulse width, a third process could establish pulse voltage, and a fourth process could establish pulse sequence duration. While four processes are described, it is to be appreciated that a greater and/or lesser number of processes could be employed and that lightweight processes, regular processes, threads, and other approaches could be employed.

Figure 4:
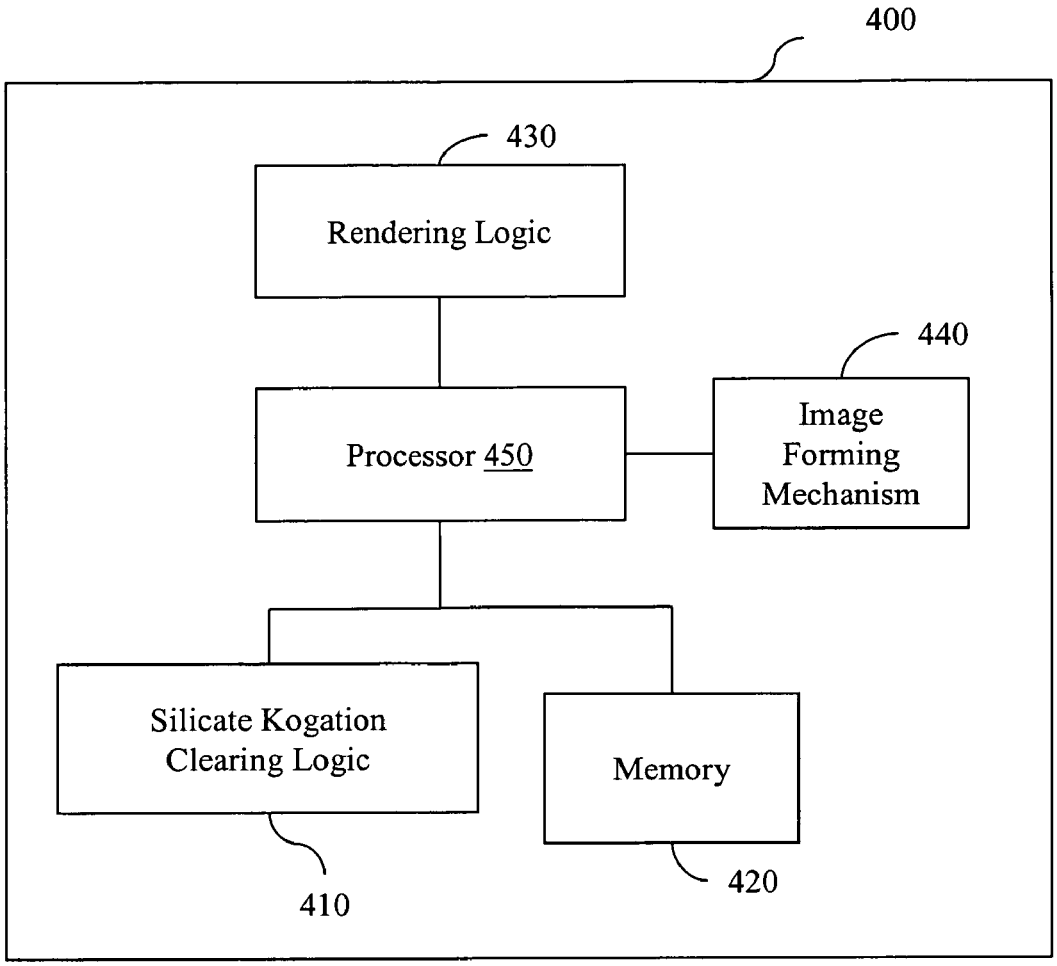
FIG. 4 illustrates an example image forming device in which example systems and methods illustrated herein can operate.

FIG. 4 illustrates an example image forming device 400 that includes a silicate kogation clearing logic 410 similar to example systems described herein. Silicate kogation clearing logic 410 may be configured to perform executable methods like those described herein. In one example, silicate kogation clearing logic 410 may be permanently and/or removably attached to image forming device 400.

Image forming device 400 may receive print data to be rendered. Thus, image forming device 400 may also include a memory 420 that is configured to store print data or to be used more generally for image processing. Image forming device 400 may also include a rendering logic 430 that is configured to generate a printer-ready image from print data. Rendering varies based on the format of the data involved and the type of imaging device. In general, rendering logic 430 converts high-level data into a graphical image for display or printing (e.g., the print-ready image). For example, one form is ray-tracing that takes a mathematical model of a three-dimensional object or scene and converts it into a bitmap image. Another example is the process of converting HTML into an image for display/printing. It is to be appreciated that image forming device 400 may receive printer-ready data that does not need to be rendered and thus rendering logic 430 may not appear in some image forming devices.

Image forming device 400 may also include an image forming mechanism 440 that is configured to generate an image onto print media from the print-ready image. Image forming mechanism 440 may include an ink jet mechanism configured as a roof shooter, a side shooter, and so on. A processor 450 may be included that is implemented with logic to control the operation of the image-forming device 400. In one example, processor 450 includes logic that is capable of executing Java instructions. Other components of image forming device 400 are not described herein but may include media handling and storage mechanisms, sensors, controllers, and other components involved in the imaging process.

Thus, in one example, image forming device 400 may be a thermal ink jet printer that is configured with an ink jet print head. The ink jet print head may be configured with a resistor for heating ink and may be configured to expel a drop of an ink in response to the resistor boiling at least a portion of the ink. The resistor heating may be controlled by an ejection pulse having a first width and a first voltage. The ejection pulse may be controlled by processor 450.

The ink jet printer may also include a silicate kogation clearing logic 410 that is operably connected to the resistor. The silicate kogation clearing logic 410 may be configured to provide a clearing pulse sequence to control the resistor to heat the ink to a clearing temperature that is lower than the boiling point of the ink. Though lower than the boiling point, the clearing temperature will be hot enough to facilitate breaking a bond between silicate based kogation on the resistor and the resistor. The heating of the resistor can be controlled by a clearing pulse sequence that includes a set of pulses with widths less than the first width and voltages in a range of from about 99% of the first voltage to about 101% of the first voltage.

While example systems, methods, and so on have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on described herein. Additional advantages and modifications will readily appear to those skilled in the art. Therefore, the invention is not limited to the specific details, the representative apparatus, and illustrative examples shown and described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995).

To the extent that the phrase "one or more of, A, B, and C" is employed herein, (e.g., a data store configured to store one or more of, A, B, and C) it is intended to convey the set of possibilities A, B, C, AB, AC, BC, and/or ABC (e.g., the data store may store only A, only B, only C, A&B, A&C, B&C, and/or A&B&C). It is not intended to require one of A, one of B, and one of C. When the applicants intend to indicate "at least one of A, at least one of B, and at least one of C", then the phrasing "at least one of A, at least one of B, and at least one of C" will be employed.

What is claimed is:

1. An apparatus, comprising:

an ink jet print head configured with a resistor for heating ink, the ink jet print head being configured to expel a drop of ink in response to the resistor heating the ink to at least an ejection temperature, the ejection temperature being at least the boiling temperature of the ink, resistor heating being controlled by an ejection pulse having a first width and a first voltage; and a silicate kogation clearing logic operably connected to the resistor, the silicate kogation clearing logic being configured to provide a clearing pulse sequence to control the resistor to heat the ink to a clearing temperature range that is lower than the ejection temperature, that is lower than the boiling temperature of the ink, and that is sufficient to facilitate breaking a bond between silicate based kogation on the resistor and the resistor.

2. The apparatus of claim 1, the clearing pulse sequence comprising a set of pulses, members of the set of pulses having a second width and a second voltage, the second width being less than the first width and the second voltage being the same as the first voltage.

3. The apparatus of claim 1, the clearing pulse sequence comprising a set of pulses, members of the set of pulses having a second width and a second voltage, the second width being less than the first width, the second voltage being in a range from 99% of the first voltage to 101% of the first voltage.

4. The apparatus of claim 3, the set of pulses being provided at a frequency of from 36 KHz to 48 KHz over a period of time from 5 seconds to 60 seconds.

5. The apparatus of claim 4, the second width being in the range of from 30% of the first width to 70% of the first width.

6. The apparatus of claim 1, the clearing pulse sequence comprising a set of pulses, members of the set of pulses having a second width and a second voltage, the second width being less than the first width, the second voltage being in a range of from 90% of the first voltage to 110% of the first voltage.

7. The apparatus of claim 6, the set of pulses being provided at a frequency of from 30 KHz to 50 KHz, the set of pulses being provided over a period of time of from 3 seconds to 90 seconds, the second width being in the range of from 25% of the first width to 75% of the first width.

8. The apparatus of claim 1, the silicate kogation clearing logic being detachably connectable to the ink jet print head.

9. The apparatus of claim 1, the clearing temperature range being in the range of from 90% of the boiling temperature of the ink to 99% of the boiling temperature of the ink.

10. The apparatus of claim 1, the silicate kogation clearing logic being configured to initiate a kogation clearing cycle in response to detecting one or more of, a drop weight falling below a desired drop weight, and a drop velocity falling below a desired drop velocity.

11. The apparatus of claim 1, the silicate kogation clearing logic being configured to initiate a kogation clearing cycle one or more of, periodically, and selectively based, at least in part, on predicting when one or more printing parameters are likely to fall below a desired threshold.

12. The apparatus of claim 1, the ink jet print head including a plurality of resistors.

13. The apparatus of claim 1, the silicate kogation clearing logic being configured to control the print head to expel a set of ink drops after a silicate clearing cycle.

14. A print head, comprising:

an ink jet mechanism configured with a resistor for heating ink within an ink channel, the ink jet being configured to expel a drop of an ink from a nozzle in response to the resistor heating the ink to at least an ejection temperature, resistor heating being controlled by an ejection pulse; and a silicate kogation clearing logic operably connected to the resistor, the silicate kogation clearing logic being configured to provide a clearing pulse sequence to control the resistor to heat the ink within the ink channel to a clearing temperature range sufficient to facilitate breaking a bond between silicate based kogation on the resistor and the resistor, the ejection temperature being at least the boiling temperature of the ink, the clearing temperature range being less than the boiling temperature of the ink where the clearing pulse sequence does not cause the ink to be ejected from the nozzle.

15. An ink jet printer configured with an ink jet print head configured with a resistor for heating ink, the ink jet print head being configured to expel a drop of ink in response to the resistor boiling at least a portion of the ink, where resistor heating is controlled by an ejection pulse having a first width and a first voltage; and a silicate kogation clearing logic operably connected to the resistor, the silicate kogation clearing logic being configured to provide a clearing pulse sequence to control the resistor to heat the ink to a clearing temperature that is lower than the boiling point of the ink, the clearing temperature being sufficient to facilitate breaking a bond between silicate based kogation on the resistor and the resistor, the clearing pulse sequence comprising a set of pulses, members of the set of pulses having a second width and a second voltage, the second width being less than the first width, the second voltage being in a range from 99% of the first voltage to 101% of the first voltage.

16. A method, comprising:

in an ink jet printer configured with a resistor for heating ink to an ejection temperature, where the resistor heating is controlled by an ejection pulse having an ejection pulse width and an ejection pulse voltage, heating at least a portion of the resistor to a clearing temperature that is insufficient to heat the ink to the ejection temperature, where heating the resistor to the clearing temperature is controlled by providing a clearing pulse sequence to the resistor for a desired period of time, the clearing pulse sequence comprising clearing pulses provided at a clearing pulse frequency, a clearing pulse having a clearing pulse width and a clearing pulse voltage, where heating at least the portion of the resistor to the clearing temperature will heat the ink to a temperature below the ejection temperature and above a temperature that will remove silicate based kogation from the resistor.

17. The method of claim 16, including determining to heat at least the portion of the resistor to the clearing temperature by determining one or more of, that a pre-defined number of drops of ink have been expelled by the ink jet printer, that one or more print quality parameters have fallen below a pre-determined threshold, and that one or more print quality parameters are approaching a pre-determined threshold.

18. The method of claim 16, the ejection temperature being at least the boiling point of the ink, the clearing temperature being less than the boiling point of the ink.

19. The method of claim 16, the clearing pulse frequency being in the range of 36 KHz to 48 KHz, the clearing pulse width being in the range of from 30% of the ejection pulse width to 70% of the ejection pulse width.

20. The method of claim 16, the clearing pulse voltage being the same as the ejection pulse voltage, the desired period of time being in the range of from 5 seconds to 60 seconds.

21. The method of claim 16, where heating at least the portion of the resistor to the clearing temperature will heat the ink to a temperature below the boiling point of the ink and that will facilitate removing silicate based kogation from the resistor without inducing nucleation.

22. The method of claim 16, including controlling the ink jet printer to expel a drop of ink by heating the ink.

23. A method, comprising:

in an ink jet printer configured with a resistor for heating an ink to above an ejection temperature where the resistor heating is controlled by an ejection pulse having an ejection pulse width and an ejection pulse voltage, determining to heat at least a portion of the resistor to a clearing temperature by determining one or more of, that a pre-defined number of drops of ink have been expelled by the ink jet printer, that one or more print quality parameters have fallen below a pre-determined threshold, and that one or more print quality parameters are approaching a pre-determined threshold; and heating at least the portion of the resistor to heat the ink to the clearing temperature by providing a clearing pulse sequence to the resistor for a desired period of time, the clearing pulse sequence comprising clearing pulses provided at a clearing pulse frequency, the clearing pulses having a clearing pulse width and a clearing pulse voltage, the clearing pulse frequency being in the range of from 36 KHz to 48 KHz, the clearing pulse width being in the range of from 30% of the ejection pulse width to 70% of the ejection pulse width, the clearing pulse voltage being the same as the ejection pulse voltage, and the desired period of time being in the range of from 5 seconds to 60 seconds, where heating at least the portion of the resistor to the clearing temperature will remove silicate based kogation from the resistor, the ejection temperature being at least the boiling point of the ink, the clearing temperature being less than the boiling point of the ink where the ink is not ejected from the nozzle during the clearing pulse sequence.

24. A computer-readable medium storing processor executable instructions operable to perform a method, the method comprising:

in an ink jet printer configured with a resistor for heating an ink to above an ejection temperature where resistor heating is controlled by an ejection pulse, heating at least a portion of the resistor to a clearing temperature that is insufficient to heat the ink to above the ejection temperature, where heating the resistor to the clearing temperature is controlled by providing a clearing pulse sequence to the resistor for a desired period of time, where heating at least the portion of the resistor to the clearing temperature will heat the ink to a temperature below the ejection temperature and above a temperature that will remove silicate based kogation from the resistor.

25. A system, comprising:

means for expelling a drop of ink from an ink jet print head configured with a resistor for heating the ink to an ejection temperature to eject the ink from a nozzle within the ink jet print head;

means for determining to clear a silicate based kogation from the resistor; and means for clearing the silicate based kogation from the print head by controlling the resistor to heat the ink to a clearing temperature that does not cause the ink to be ejected from the nozzle but is above a temperature to facilitate breaking a bond between the resistor and silicate based kogation on the resistor.

26. A method, comprising:

establishing a frequency at which a pulse sequence will be provided to a resistor in a thermal ink jet print head;

establishing a pulse width for a pulse in the pulse sequence;

establishing a pulse voltage for a pulse in the pulse sequence;

establishing a duration for the pulse sequence; and providing the pulse sequence to the resistor, the pulse sequence being configured to heat the resistor to a temperature that will heat ink that is in contact with the resistor to a temperature between 75% of the boiling temperature of the ink and 99% of the boiling temperature of the ink.

* * * * *